United States Patent [19]

Babarin

[11] Patent Number: 4,593,439

[45] Date of Patent: Jun. 10, 1986

[54] BUCKLE FOR BELT

[76] Inventor: Sergei Babarin, 21-57 Holland Ave., Apt. L, Bronx, N.Y. 10462

[21] Appl. No.: 669,256

[22] Filed: Nov. 5, 1984

[51] Int. Cl.[4] ..... A44B 11/00

[52] U.S. Cl. ..... 24/197; 24/191; 24/182

[58] Field of Search ..... 24/170, 585, 191, 197, 24/171, 574, 182, 584, 586, 611, 613

[56] References Cited

U.S. PATENT DOCUMENTS

| | | | |
|---|---|---|---|
| 313,529 | 3/1885 | Regan | 24/182 X |
| 1,159,328 | 11/1915 | Padelford | 24/191 |
| 1,386,805 | 8/1921 | Scheer | 24/191 |
| 1,416,290 | 5/1922 | Hart | 24/191 |
| 1,505,125 | 8/1924 | Armstrong | 24/191 |
| 1,510,643 | 10/1924 | Anderson | 24/191 |
| 3,060,537 | 10/1962 | Hatfield | 24/197 |

FOREIGN PATENT DOCUMENTS

| | | | |
|---|---|---|---|
| 446002 | 11/1912 | France | 24/197 |

*Primary Examiner*—William E. Lyddane
*Assistant Examiner*—Laurie K. Cranmer
*Attorney, Agent, or Firm*—Ilya Zborovsky

[57] ABSTRACT

A buckle for a belt has a central plate with two projections extending along its longitudinal side and each having two openings, and two connecting members for connecting ends of a belt with the central plate and having a formation for connecting with the end of the belt and two pins arranged so that the pins of one connecting member engage pivotably and non-removably in one opening of each of the projections of the plate, whereas the pins of the other connecting member are engageable pivotably and removably into the other opening of the projections of the plate by first placing the other connecting member in an inclined position relative to the projections and then turning the other connecting member to a position parallel to a transverse side of the plate.

5 Claims, 13 Drawing Figures

FIG. 1a
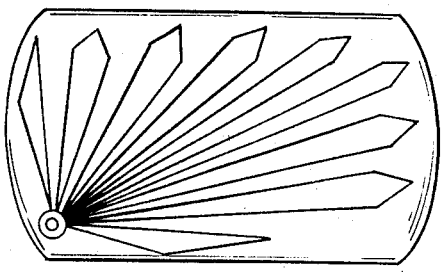
FIG. 1b
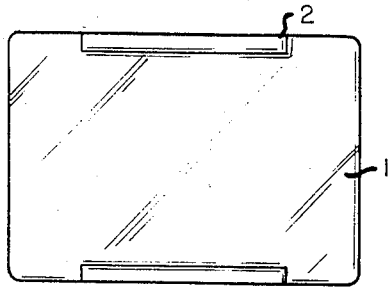
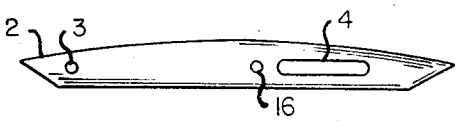
FIG. 1c
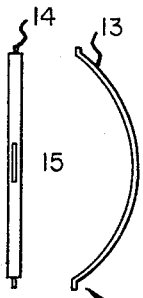
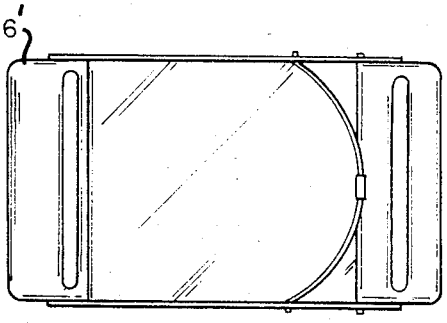
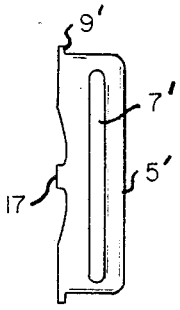
FIG. 6a FIG. 6b FIG. 7 FIG. 5
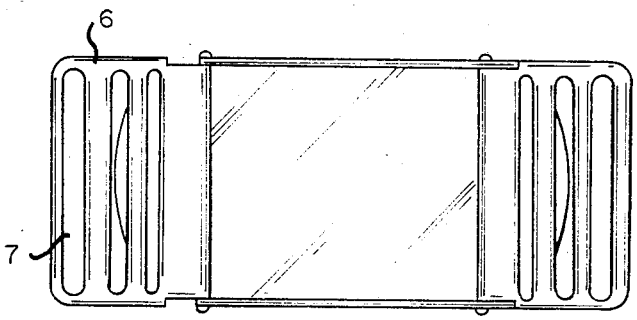
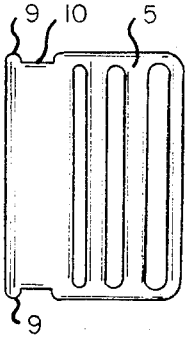
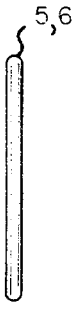
FIG. 3 FIG. 2a FIG. 2e

BUCKLE FOR BELT

BACKGROUND OF THE INVENTION

The present invention relates to a buckle for a belt.

There are great numbers of buckles for belts. They differ from one another in their shape, construction, size, appearance and the like. The known buckles possess some disadvantages in the sense of their construction, manufacture, manner of operation, etc.

SUMMARY OF THE INVENTION

Accordingly, it is an object of the present invention to provide a buckle for a belt, which is an improvement of the existing buckles.

In keeping with these objects and with others which will become apparent herein after, one feature of the present invention resides, briefly stated in a buckle which has a central plate with two longitudinal projections each having two openings, and two connecting elements each connectable with a respective end of a belt and each having two pins at their longitudinal ends arranged so that the pins of one connecting element are engageable in pivotable and not-removable manner in one opening of the projections of the plate, whereas the pins of the other connecting member are engageable in the other opening of the projections in pivotable and removable manner by first placing the other connecting member in an inclined position relative to the projections and then turning the other connecting member to a position parallel to the transverse sides of the plate.

When the buckle is designed in accordance with the present invention, is is simple to manufacture, easy to operate, and has a new original construction.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIGS. 1A, 1B, 1C are a front view, a rear view and a side view of a central plate of the inventive buckle;

FIGS. 2A and 2B are a front view and a side view of a connecting element of the inventive buckle in accordance with one embodiment of the present invention;

FIG. 3 is the inventive buckle in the assembled, condition in accordance with the one embodiment of the invention;

FIG. 5 is a side view of a connecting element in accordance with another embodiment of the invention;

FIGS. 6A and 6B are a front view and a side view of a spring of the buckle in accordance with the other embodiment of the invention;

FIG. 7 is a view showing the buckle in accordance with the other embodiment of the invention in an assembled condition;

DESCRIPTION OF PREFERRED EMBODIMENTS

Figure 8:
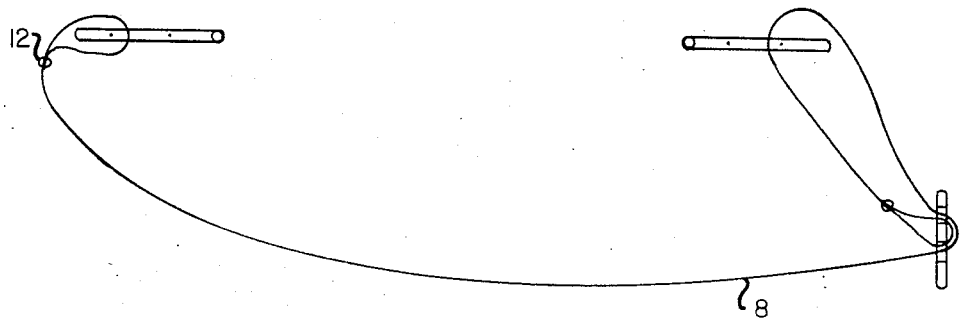
FIG. 8 is a view schematically showing threading of the belt ends into the elements of the inventive buckle in accordance with the other embodiment of the invention.

A buckle for a belt in accordance with the present invention has a central plate which is identified with reference numeral 1. The plate 1 has two projections 2 extending along longitudinal sides of the plate and each having two openings 3 and 4. The openings 4 are elongated in the longitudinal direction as can be clearly seen from FIG. 1C. As can be seen from FIG. 1A, a pattern can be provided on a front side of the plate, which can be either painted on the front side or formed as a separate element attached to the front side. The above-mentioned projections 2 are arranged at the rear side of the plate 1.

Figure 4:
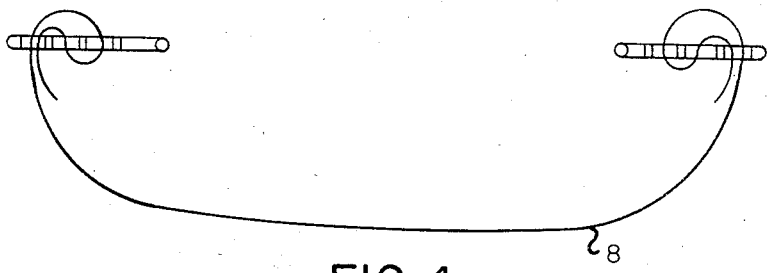
FIG. 4 is a view schematically illustrating threading of belt ends into the connecting elements of the buckle in accordance with the one embodiment of the invention.

The buckle further has two connecting members 5 and 6. The connecting members are provided with a plurality of transverse slots 7 as can be seen from FIGS. 2A and 3 and therefore the respective ends of a belt 8 can be threaded several times through the slots 7, as shown in FIG. 4, and retained in the connecting members without additional retaining means.

Each of the connecting elements has two pins 9 provided at opposite longitudinal sides. The pins 9 are separated from the remaining portions of the connecting members by small grooves 10.

Figure 9:
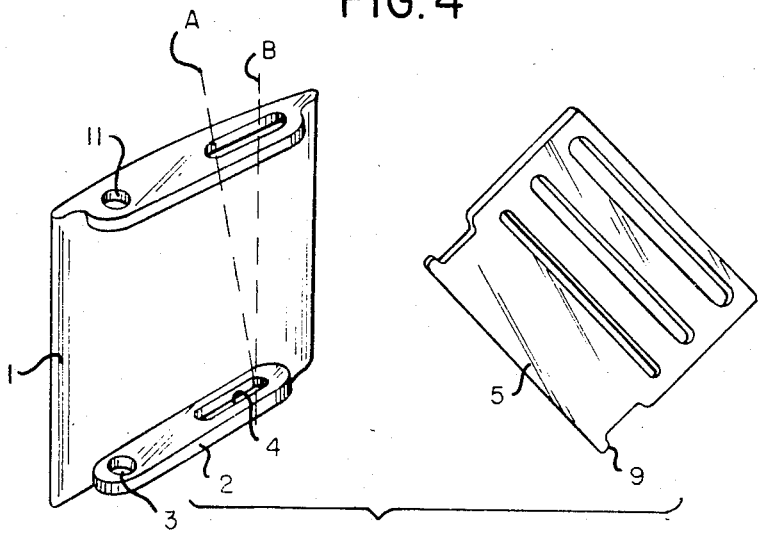
FIG. 9 is a view schematically illustrating locking of the inventive buckle.

The connecting member 6 is connected with the plate 1 pivotably and non-removably. This connection is performed by engagement of the pins 9 of the connecting member 6 into the openings 3 of the projections 2 of the plate 1 and retaining the pins there, for example, by inserts 11 shown in FIG. 9. The connecting member 5 is connectable with the plate in pivotable and removable manner so as to lock and unlock the buckle. In order to lock the buckle, the connecting member 5 is placed relative to the plate 1 in the position identified with reference A in FIG. 9 or in other words in an inclined position relative to the projections 2 of the plate 1, so that one pin 9 of the connecting member 5 for example the lower pin 9 in FIG. 9 can be easily inserted into the opening 4 of the lower projection 2 of the plate 1, and there after the connecting member 5 is turned so as to assume the position parallel to the transverse sides of the plate 1 in which position the second pin or the upper pin 9 of the connecting member 5 also engages into the opening 4 of the upper projection 2 of the plate 1. Unlocking of the buckle is performed by disengagement in a reverse order.

In accordance with another embodiment of the invention, the connecting members 5' and 6' are provided with only one slot 7'. For retaining the ends of the belt in the slots 7' additional fixing elements 12 are provided, as can be seen in FIG. 8. In the buckle of this embodiment of this embodiment there is a spring 13 having two pin-shaped ends 14 engageable in further opening 16 of the projections 2 of the plate 1. The spring 13 also has a central hole 15. The connecting member 5' has, in turn, a lug 17. When in the locked position of the buckle the pins 9' of the connecting member 5' engage in the openings 4 of the projections 2 of the plate 1, the lug 17 of the connecting member 5' extends through the hole 15 of the spring 13 and therefore the connecting member 5' is firmly retained in the plate 1.

The invention is not limited to the details shown since various modifications and structural changes are possible without departing in any way from the spirit of the present invention.

What is desired to be protected by Letters Patent is set forth in the appended claims:

1. A buckle for a belt, comprising a central plate having two longitudinal sides and two transverse sides, said plate is provided with two projections each located at a respective one of said longitudinal sides and each having three openings spaced from one another in a longitudinal direction and including two end openings and a middle opening located therebetween; two connecting members each having two longitudinal sides and two transverse sides and each connecting a respective end of a belt to said plate, each of said connecting members is provided with means for adjustably connecting with a respective end of a belt, each of said connecting members is also provided at each longitudinal side with a pin, each of said pins of one of said connecting members being pivotably and nonremovably engaged in one end opening of a respective one of said projections of said plate, each of said pins of the other of said connecting members being engageable in a pivotable and removable manner in the other end opening of a respective one of said projections of said plate, at least one of said other end openings being elongated and said other connecting member being insertable by first placing said other connecting member in an inclined position relative to said projections and then turning said other connecting member in a position parallel to said transverse sides of said plate; and means for retaining said other connecting member in engagement with said plate and including a flat spring which engaged spring-biases said other connecting member, said spring having two end pins each engaging in said middle opening of a respective one of said projections of said plate, so that said one connecting member, said spring and said other connecting members are held in said projections by engagement of said pins into said openings.

2. A buckle as defined in claim 1, wherein said means for connecting said connecting members with the end of a belt includes at least one slot extending parallel to said transverse sides of said connecting member.

3. A buckle as defined in claim 1, wherein said means for connecting said connecting members with the ends of a belt include a plurality of slots provided in each of said connecting members and extending parallel to said transverse sides of said connecting member spaced from one another in a direction parallel to said longitudinal side of said connecting member.

4. A buckle as defined in claim 1, wherein said other connecting member has a lug, said spring being attached to said plate and having a hole through which said lug of said other connecting member extends in the engaged position.

5. A buckle as defined in claim 1, wherein said connecting members have identical shapes and dimensions.

* * * * *